US005729615A

United States Patent [19]

Yang

[11] Patent Number: 5,729,615

[45] Date of Patent: Mar. 17, 1998

[54] IN-EAR TYPE EARPHONE HAVING AN EAR HANGER

[75] Inventor: Bill Yang, Taipei, Taiwan

[73] Assignee: Cotron Corporation, Taiwan

[21] Appl. No.: 789,618

[22] Filed: Jan. 27, 1997

[30] Foreign Application Priority Data

Dec. 28, 1996 [TW] Taiwan ..... 85220239

[51] Int. Cl.[6] ..... H04R 25/00

[52] U.S. Cl. ..... 381/183; 381/187; 381/151; 181/129

[58] Field of Search ..... 379/430, 431; 381/151, 183, 187, 68.6, 68.7, 68.5, 68.3; 181/135; 455/350

[56] References Cited

U.S. PATENT DOCUMENTS

| | | | |
|---|---|---|---|
| 3,431,370 | 3/1969 | Crosby | 381/68.5 |
| 4,529,058 | 7/1985 | Emery | 381/187 |
| 5,134,655 | 7/1992 | Jensen | 381/187 |
| 5,412,736 | 5/1995 | Keliiliki | 381/183 |
| 5,459,290 | 10/1995 | Yamagishi | 181/129 |
| 5,625,171 | 4/1997 | Marshall | 381/187 |
| 5,655,026 | 8/1997 | Peters et al. | 381/187 |

FOREIGN PATENT DOCUMENTS

| | | |
|---|---|---|
| 0 351 461 | 1/1990 | European Pat. Off. . |
| 2 096 861 | 10/1982 | United Kingdom . |

*Primary Examiner*—Curtis Kuntz
*Assistant Examiner*—Rexford Barnie
*Attorney, Agent, or Firm*—Cushman Darby & Cushman IP Group of Pillsbury Madison & Sutro LLP

[57] ABSTRACT

An in-ear type earphone according to the present invention includes an in-ear type speaker element and a cable disposed externally of the earphone. The cable is coupled at one end to the speaker element such that the cable hangs freely from the speaker element. The opposite end of the cable is coupled to a plug. The plug operatively connects the earphone to a sound signal source. A sliding round shaft is rotatably mounted at one end of the speaker element. A sliding sleeve receives an opposite end of the sliding round shaft and allows it to move along a longitudinal axis. The earphone also has an ear hanger with a helix stopper end, a curved hook section, and a lobule stopper end integrally formed and contoured to the general shape of a human ear. The helix stopper end is mounted to the sliding sleeve in a fixed manner.

10 Claims, 4 Drawing Sheets

IN-EAR TYPE EARPHONE HAVING AN EAR HANGER

BACKGROUND OF THE INVENTION

1. Field of the Invention

This invention relates in general to an in-ear type earphone having an ear hanger. In particular, this invention relates to an earphone having an ear hanger for comfortable and secure attachment to the human external ear using the ergonomical stopper design of the ear hanger and a adjusting means allowing the speaker element longitudinal and rotating adjustment to fit all ears. More particularly, the invention relates to an earphone that its cable is free from being twisted.

2. Description of Related Art

In-ear phone is widely used in conjunction with an audio means, such as a portable radio, a stereo cassette player, an audio CD (compact disc) player, a pager, or a mobile phone, to serve as a small sound receiving means which can be placed in the ear for the user to hear the sound from the associated audio means. An in-ear phone is composed of at least one speaker element (a pair of speaker elements usually) that can be fitted into the user's ears and a pair of cables connecting the speaker elements to the associated audio equipment.

During use of the in-ear phone, the somewhat long and stretched cables connecting the speaker elements to the associated audio means can be pulled accidentally by the user or nearby person, thereby drawing the speaker elements out of the user's ears. This will not only cause interrupt to the reception of sound. The forceful jerking of the speaker elements from the user's ears could also cause injury to the user's ears and also cause damage to the connection of the earphone set.

As a result, an attached ear hanger was added to the in-ear type earphone. In some occasions, a microphone can also be added to the device for communication involving the use of these in-ear type earphones.

FIG. 1 of the accompanying drawings depicts a conventionally known in-ear type earphone, with added ear hanger for increased fixing capability to the ear, as disclosed in U.S. Pat. No. 5,412,736. The earphone system includes a speaker element 11, an ear hanger 12 attempting to be contoured to adopt to the shape of the human external ear, a cable 13 that serves to transmit sound signals to the speaker element 11, and a plug 14 to be inserted into the corresponding socket of a sound generating source for receiving sound signals. The connection of the speaker element 11 to the extended section of the ear hanger 12 is pivotally flexible so that the speaker element 11 is provided with rotational freedom while the speaker element 11 is comfortably fitted in the ear. The cable 13 passes through an internal channel in the ear hanger 12 and leads to the speaker element 11. The cable 13 is partially fixed in the ear hanger 12.

The earphone described above, though flexible in the connection between its speaker element and the ear hanger, lacks the adjustability of the hanger itself for fitting to the different ear shapes and sizes of users of various ages and body figures. As a result, an improvement was proposed as is illustrated in FIG. 2. The earphone of FIG. 2 is different from the one described above by that an additional adjustable sliding section 16 connects between the speaker element 15 and the ear hanger 17. Thus, the speaker element 15, except being pivotally flexible with respect to the sliding section 16 (as indicated by the circular arrow B), is also slidably adjustable in its relative position with respect to the ear hanger 17 (as is indicated by the phantom-lined shadow of the speaker element in the up and down directions designated by the bi-directional arrow A). This apparently brings the earphone of FIG. 2 more flexibility to adjust to more ear shapes and sizes than that of FIG. 1. For achieving this, except for a section of the cable 18 for connecting to the speaker element 15 is exposed, the other sections of the wire can still be buried inside the internal channel in the ear hanger 17 and partially fixed in the ear hanger 17.

Both the earphones of FIGS. 1 and 2, however, suffer from at least the following drawbacks. First of all, due to the fact that the cable for transmitting sound signals to the speaker element are hidden inside the ear hanger and partially fixed in the ear hanger, when the speaker element rotates, the cable is subject to constant twist. Soldering point of the cable to the speaker element may break, and sound signals may be lost as a result. Second, ear hangers are frequently made of flexible material that lacks fixing arrangement for securing to the user's external ear. Inevitable stretches in the cable of the earphone would result in the dislocation of the ear hanger and user wearing comfort problems.

SUMMARY OF THE INVENTION

It is therefore an object of the invention to provide an earphone allowing for comfortable attachment to the human external ear using the stopper design of the ear hanger. It is another object of the invention to provide an earphone preventing damage to the soldering point of the cable to the speaker element and the twisting of the cable.

It is yet another object of the invention to provide an earphone allowing for comfortable and secure attachment to the human external ear while preventing damage to the soldering point of the cable to the speaker element of the earphone.

The present invention achieves the above-identified objects by providing an earphone having a comfortable and secure attachment ear hanger. Such an earphone comprises an in-ear speaker element, a cable and a plug. The cable mounts at one end to the speaker element for transmitting sound signals from a remote device. The plug mounted to the other end of the cable is used for insertion to a corresponding socket in the remote device. A sliding round shaft is pivotally mounted to the speaker element at one end and the other end thereof is received in a sliding sleeve allowing for the sliding movement along the longitudinal axis and rotating freely. A hanger includes an integrally-formed helix stopper end, a curved hook section and a lobule stopper end. The helix stopper end is mounted to the sliding sleeve in a fixed manner at one end of the hanger. The curved hook section is contoured to conform to the interface contouring behind the helix of the human external ear. The lobule stopper end extends at the other end of the hanger for shoring into the concavity portion between the mastoid bone and the lobule.

The earphone of the invention has two ergonomical stopper design of the ear hanger, that is, the helix stopper end and the lobule stopper end so that the earphone of the invention is comfortable attachment to the human external ear. Further, according to the invention, the cable is exposed without being buried in the ear hanger so that the cable is prevented being twisted by the rotation of the speaker element. Therefore, the earphone of the invention prevents damage to the soldering point of the cable to the speaker element and protends the life of the earphone.

BRIEF DESCRIPTION OF THE DRAWINGS

Other objects, features, and advantages of the present invention will become apparent by way of the following detailed description of the preferred but non-limiting embodiments. The description is made with reference to the accompanying drawings in which.

DESCRIPTION OF THE PREFERRED EMBODIMENT

Figure 1:
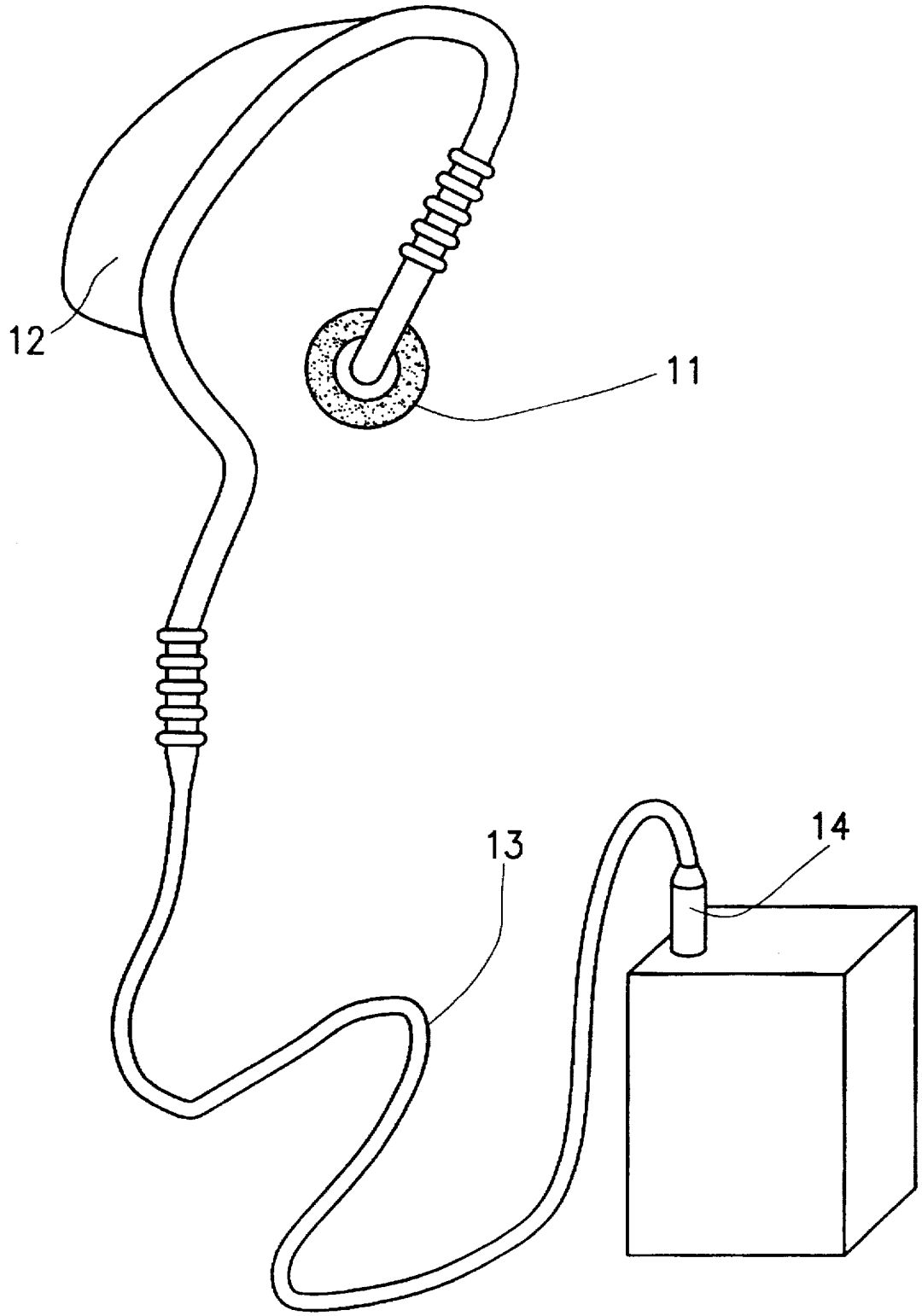
FIG. 1 (PRIOR ART)
FIG. 1 illustrates a conventional in-ear type earphone having ear hanger.
Figure 2:
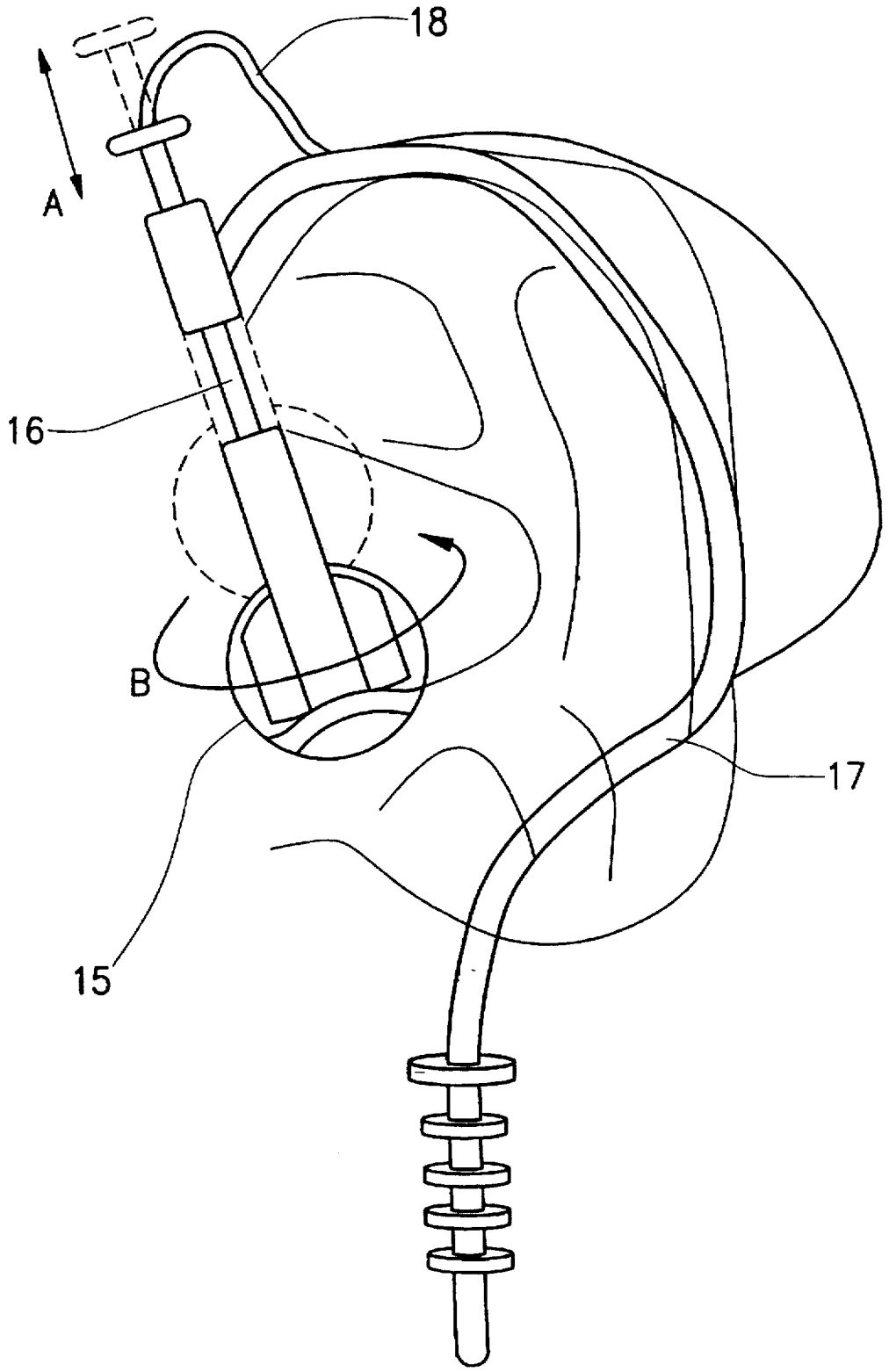
FIG. 2 (PRIOR ART)
FIG. 2 illustrates another conventional in-ear type earphone having hanger with adjustable sliding section.
Figure 3:
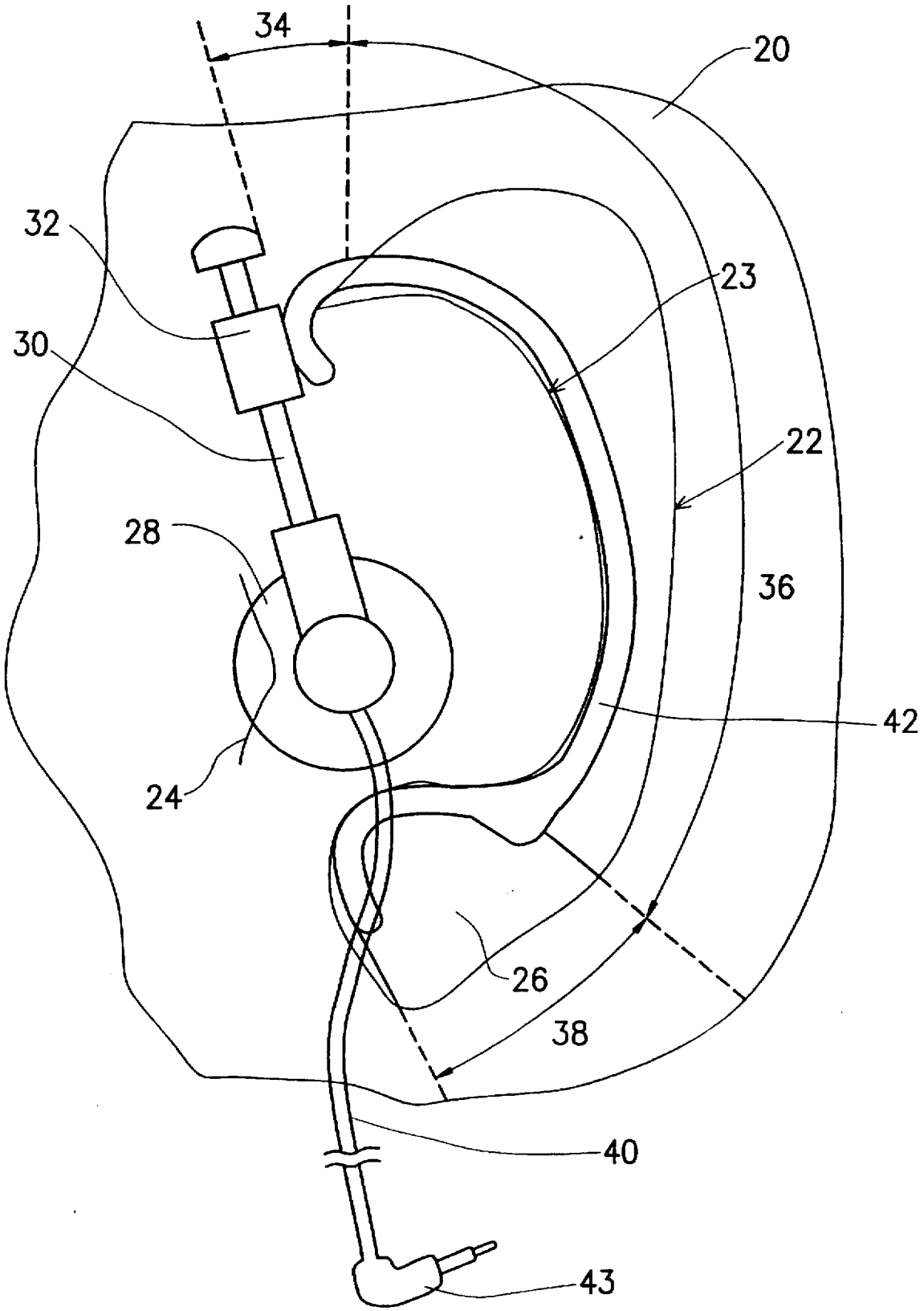
FIG. 3 illustrates an in-ear type earphone in accordance with a preferred embodiment of the invention that is adopted to the human external ear.
Figure 4:
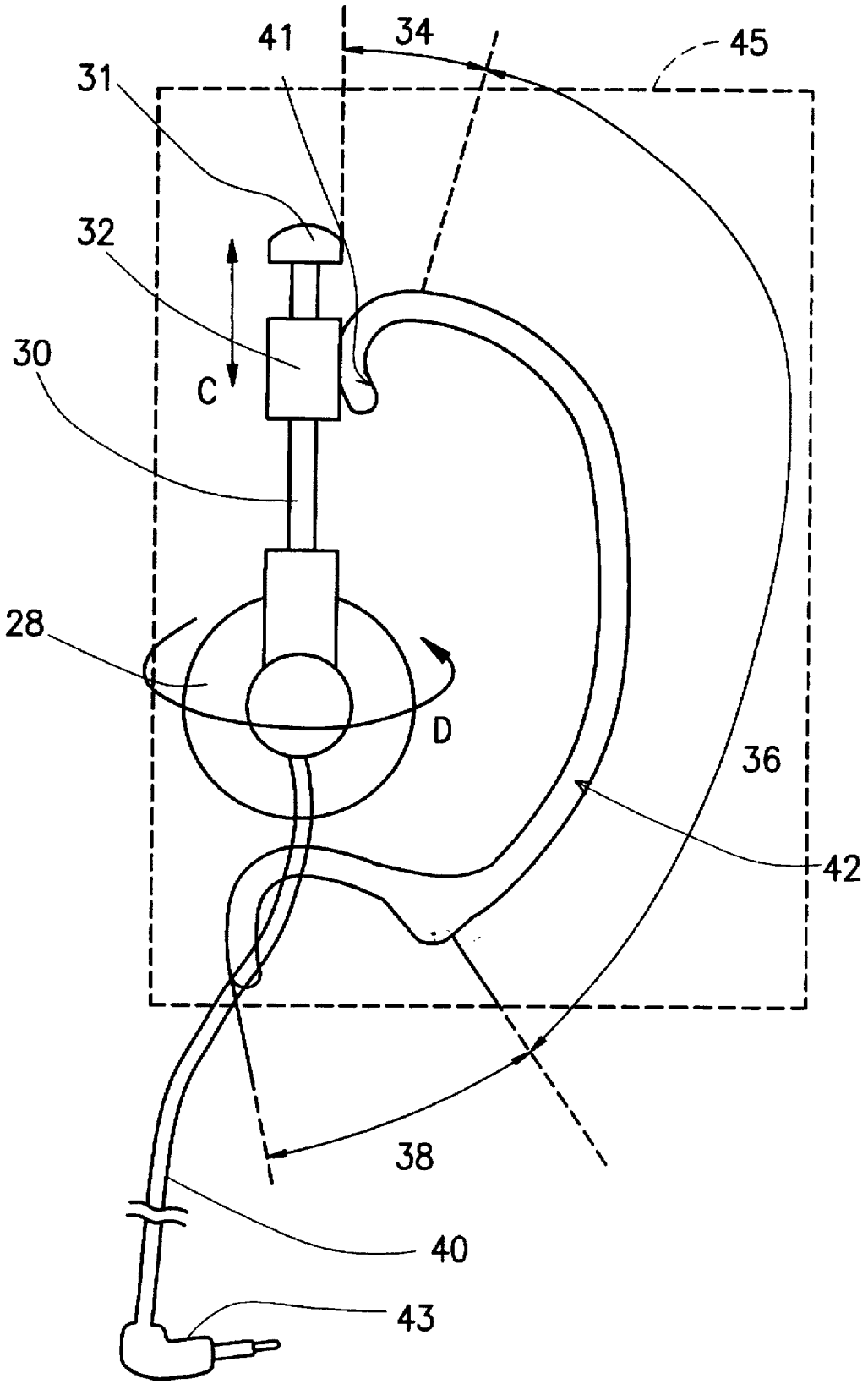
FIG. 4 illustrates the in-ear type earphone of FIG. 3.

Refer to FIGS. 3 and 4 of the drawings for the description of an in-ear type earphone in accordance with a preferred embodiment of the invention. As is shown in FIG. 3, the earphone has an in-ear type speaker element 28, a sliding round shaft 30, a sliding sleeve 32, an ear hanger 42, a cable 40 and a plug 43. A sliding round shaft 30 is slidably movable along the longitudinal axis thereof inside the sliding sleeve 32.

The speaker element 28 is pivotally rotatable with respect to the sliding round shaft 30 as the former is attached to one end of the latter. As is illustrated in the drawing, this allows the speaker element 28 to be pivotally rotatable with respect to the sliding round shaft 30 shown by the circular arrow D. The speaker element 28 has a near-spherical shape, or a tear drop-shaped configuration that is suitable for fitting in the ear. The insertion of the speaker element 28 in the ear is in a comfortable manner as it is inserted in the ear behind the tragus and at the meatus opening of the external ear.

On the other hand, the sliding round shaft 30 is allowed, and confined, to slide along its longitudinal axis inside and with respect to the sliding sleeve 32. This is schematically shown in the drawing by the bi-directional arrow C. Thus, the combination of speaker element relative movements with respect to the hanger makes wearing the earphone of the invention quite comfortable if properly adjustment is made.

Over the other end of the sliding round shaft 30 opposing the end where the speaker element 28 is pivotally attached, a stopper block 31 is preferably fixed. This stopper block 31 serves to prevent the sliding round shaft 30 from falling apart with the other components of the earphone, in particular, the sliding sleeve 32, when the speaker element 28 is slid to adjust position toward the downward direction as observed in the drawing. The stopper block 31 may be an enlarged structural part having larger diameter than that of the round shaft 30, which is allowed to be slidable inside the sliding bore of the sleeve 32.

The ear hanger 42 is a contoured into the shape generally conforming to the external curvature behind a human outer ear. Essentially, this includes three sections as described with reference to the drawing. In FIG. 4, a first section is the helix stopper end 34 generally identified in the drawing as the section between two phantom lines. This helix stopper end 34 is directly mounted to the body of the sliding sleeve 32 and has a short protruding end 41. The protruding end 41 extends toward the direction leading away from the point of attachment to the sliding sleeve 32 by the ear hanger 42.

Then, there is the curved hook section 36 generally identified in the drawing as the section between two corresponding phantom lines. This is a long section that has a contour generally conforming to the interfacing line 23 between the external ear helix 22 and the portion of the human head 20. Note that the human external ear helix is schematically represented in the drawing by a contour line 22, only to show the general shape of a human outer ear.

Further to the curved hook section 36, the ear hanger 42 has a lobule stopper end 38, also generally identified in the drawing as the section between two corresponding phantom lines. The lobule stopper end 38 is used to shore into the generally concavity portion of the external ear behind the mastoid bone (not shown in the drawing) connecting to the ear lobule 26. As is shown in the drawing, the lobule stopper end 38 is substantially contoured into a half circle.

Thus, the hanger 42 is generally composed of three sections, namely the helix stopper end 34, the curved hook section 36, and the lobule stopper end 38. The three sections are formed into one integral piece using suitable material that is sufficiently flexible and resilient for wearing comfortably behind the human external ear. The cable 40 is coupled to the speaker element 28 for transmitting sound signals from a remote device by insertion of the plug 43 into the corresponding socket of the device. Though not shown in the drawing, this external signal generating device may be, for example, a walkman cassette or CD player, or a radio receiver, as is widely known in the art.

In FIG. 4, the earphone is illustrated to be a system generally enclosed in the phantom-lined box identified by the reference numeral 45. This earphone is a construction including the speaker element 28, the sliding round shaft 30, the sliding sleeve 32 and the ear hanger 42 that is connected to the signal source via the cable 40 and its corresponding plug 43. In this exemplified embodiment, the cable 40 is exposed external to the earphone system by directly connecting to the speaker element 28.

A single earphone 45 of FIG. 4 may be used to constitute a earphone system for mono applications such as mobile phone, or radio receiver. However, a pair of similar earphones 45 can also be used to make up a stereo earphone system that is well suited to the leisure musical enjoyment of walkman or stereo radio broadcast.

When the preferred embodiment of the earphone described in FIGS. 3 and 4 is used, the ear hanger 42 thereof can be used to comfortably and securely attach behind the helix of the human external ear. This is achieved by having the helix stopper end 34 and the lobule stopper end 38 to jointly grab the entire ear helix, with the curved hook section 36 comfortably conforming to the contour line behind the ear helix.

Meanwhile, since the cable 40 is not buried into the ear hanger 42 and is allowed to freely move as the user body changes position, therefore, cable twisting is avoided. This prevents the undesirable situation wherein the soldering point of the cable 40 to the speaker element 28 is damaged. Improved earphone life expectancy can therefore be possible.

While the invention has been described by way of example and in terms of preferred embodiment, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An in-ear earphone comprising:

an in-ear type speaker element;

a cable disposed external of the speaker element, the cable being coupled at one end to the speaker element such that the cable hangs freely from the speaker element and coupled at an opposite end to a plug, the plug being configured to operatively connect the earphone to a sound signal source;

a sliding shaft having a longitudinal axis mounted at one end to the speaker element;

a sliding sleeve receiving an opposite end of the sliding shaft and allowing the sliding shaft to move along the longitudinal axis thereof; and an ear hanger comprising a helix stopper end, a curved hook section, and a lobule stopper end integrally formed and contoured to a general shape of a human ear, the helix stopper end being mounted to the sliding sleeve in a fixed manner, wherein the speaker element rotates with respect to the longitudinal axis of the sliding shaft.

2. The earphone of claim 1, wherein the lobule stopper end is contoured in a semicircular shape for fitting into a generally concave portion between a lobule and a mastoid bone.

3. The earphone of claim 1, wherein the ear hanger is made of flexible and resilient material.

4. A stereo in-ear type earphone system comprising:

a first in-ear type speaker element;

a second in-ear type speaker element;

a first cable disposed external of the first speaker element, the first cable being coupled at one end to the first speaker element such that the first cable hangs freely from the first speaker element and coupled at an opposite end to a plug, the plug being configured to operatively connect the earphone to a sound signal source;

a second cable disposed external of the second speaker element, said second cable being coupled at one end to the second speaker element such that the second cable hangs freely from the second speaker element and coupled at an opposite end to said plug;

a first sliding shaft mounted at one end to the first speaker element having a first longitudinal axis; and a first sleeve receiving an opposite end of the first sliding shaft and allowing the first sliding shaft to move along the first longitudinal axis thereof;

a second sliding shaft mounted at one end to the second speaker element having a second longitudinal axis; and a second sleeve receiving an opposite end of the second sliding shaft and allowing the second sliding shaft to move along the second longitudinal axis thereof;

a first ear hanger comprising a first helix stopper end, a first curved hook section, and a first lobule stopper end integrally formed and contoured to a general shape of a human ear, the first helix stopper end being mounted to the first sliding sleeve in a fixed manner; and a second ear hanger comprising a second helix stopper end, a second curved hook section, and a second lobule stopper end integrally formed and contoured to a general shape of a human ear, the second helix stopper end being mounted to the second sleeve in a fixed manner, wherein the first speaker element rotates with respect to the first longitudinal axis of the first sliding shaft, and the second speaker element rotates with respect to the second longitudinal axis of the second sliding shaft.

5. The stereo in-ear type earphone system of claim 4, wherein each lobule stopper end is contoured in a semicircular shape for fitting into the generally concave portion between a lobule and a mastoid bone.

6. The stereo in-ear type earphone system of claim 4, wherein each ear hanger is made of flexible and resilient material.

7. The in-ear earphone according to claim 1 wherein the in-ear type speaker element is rotatably mounted to the sliding shaft.

8. The in-ear earphone according to claim 1 wherein the sliding shaft is round.

9. The stereo in-ear type earphone system according to claim 4 wherein the first in-ear type speaker element is rotatably mounted to the first sliding shaft and the second in-ear type speaker element is rotatably mounted to the second sliding shaft.

10. The stereo in-ear type earphone system according to claim 4 wherein the first sliding shaft and the second sliding shaft are round.

* * * * *